US008056197B2

(12) United States Patent
Kemmerer

(10) Patent No.: US 8,056,197 B2
(45) Date of Patent: Nov. 15, 2011

(54) BLANK AND AN ASSEMBLY FOR A COFFIN

(75) Inventor: Eckhard Kemmerer, Eastwood (AU)

(73) Assignee: Apogee International Pty Ltd., Abbotsford (AU)

( * ) Notice: Subject to any disclaimer, the term of this patent is extended or adjusted under 35 U.S.C. 154(b) by 945 days.

(21) Appl. No.: 11/721,295

(22) PCT Filed: Dec. 12, 2005

(86) PCT No.: PCT/AU2005/001876

§ 371 (c)(1),
(2), (4) Date: Jun. 8, 2007

(87) PCT Pub. No.: WO2006/060879

PCT Pub. Date: Jun. 15, 2006

(65) Prior Publication Data

US 2009/0249593 A1 Oct. 8, 2009

(30) Foreign Application Priority Data

Dec. 10, 2004 (AU) ..... 2004907071

(51) Int. Cl.
*A61G 17/00* (2006.01)

(52) U.S. Cl. ..... 27/4; 27/14

(58) Field of Classification Search ..... 27/4, 14, 27/19, 2; 229/100, 116.1, 125.01, 199, 199.1, 229/166, 183; 220/6
See application file for complete search history.

(56) References Cited

U.S. PATENT DOCUMENTS

| | | | | |
|---|---|---|---|---|
| 4,156,956 | A | 6/1979 | Patridge et al. | |
| 4,773,134 | A * | 9/1988 | Kay | 27/14 |
| 4,967,455 | A * | 11/1990 | Elder | 27/4 |
| 5,035,032 | A | 7/1991 | Nutting | |
| 5,111,559 | A | 5/1992 | Mohr et al. | |
| 5,307,545 | A * | 5/1994 | Stoltz | 27/4 |
| 5,353,484 | A * | 10/1994 | Woedl et al. | 27/4 |
| 5,454,141 | A * | 10/1995 | Ozbun et al. | 27/4 |
| 5,740,592 | A * | 4/1998 | Lau | 27/4 |
| 5,960,978 | A * | 10/1999 | Jenkins | 220/200 |
| 6,105,220 | A * | 8/2000 | Belanger | 27/4 |
| 6,145,175 | A * | 11/2000 | Enneking et al. | 27/4 |
| 6,640,401 | B2 * | 11/2003 | Chen et al. | 27/4 |

FOREIGN PATENT DOCUMENTS

| | | |
|---|---|---|
| CA | 2154009 | 7/1995 |
| GB | 2 284 436 | 12/1995 |
| GB | 2 346 137 | 2/2000 |
| GB | 2415424 A * | 12/2005 |
| WO | WO 81/02669 | 10/1981 |
| WO | WO 82/04186 | 12/1982 |
| WO | WO 95/08973 | 4/1995 |

OTHER PUBLICATIONS

Written Opinion mailed Jan. 25, 2006 (3-pgs.). Remarks to Article 34 Amendment and Demand filed Oct. 9, 2006. (5-pgs.).
International Preliminary Report on Patentability (IPRP) mailed Oct. 31, 2006 (3-pgs.).
International Search Report mailed Jan. 25, 2006 (2-pgs.).

* cited by examiner

*Primary Examiner* — William L. Miller
(74) *Attorney, Agent, or Firm* — King & Spalding

(57) ABSTRACT

A blank (10) for a coffin comprising a blank body (12) defining a plurality of wall panels (14, 16, 18, 20) each having a pair of opposed sides; a base supporting member (28) formed integrally with one side of at least one of the panels; and a flap member (30) formed integrally with opposite side of at least one of panels. In one embodiment an insert (58) is held captive between at least one of side wall panels of the blank body and their associated flap portions folded onto the side wall panels to impart rigidity to a side wall of a coffin formed from blank.

35 Claims, 6 Drawing Sheets

BLANK AND AN ASSEMBLY FOR A COFFIN

CROSS REFERENCE TO RELATED APPLICATIONS

This is the National Stage filed under 35 U.S.C. §371 of International Application PCT/AU2005/001876 filed on Dec. 12, 2005, which designated the United States of America, the disclosure of which is incorporated herein by reference.

TECHNICAL FIELD

This invention relates to a blank for a coffin. The invention further relates to a side wall assembly for a coffin and a lid assembly for a coffin.

BACKGROUND ART

In response to rising costs for coffins and caskets, coffin manufacturers have turned to a variety of low cost materials. Such materials include plastics and low grade timber particle board, such as chipboard and medium density fibreboard (MDF).

As a result of increasing environmental concerns, chipboard and MDF are coming under scrutiny. Coffins formed from either of these materials use unnecessary amounts of wood, produce chemical pollutants when burnt and the coffins if buried are particularly slow to breakdown and decompose. Biodegradable materials such as cardboard or corrugated board offer significant environmental benefits.

One major concern when using cardboard or corrugated board is that of appearance. Customers typically desire a product that looks expensive yet is inexpensive to purchase. A further equally important concern is that coffins constructed from cardboard, or other like materials, typically lack structural integrity. In use, this often results in difficulty in carrying the coffin. Handles, if provided, are usually only decorative. Further, the lid must usually be permanently sealed with glue, preventing it from being opened and closed.

DISCLOSURE OF INVENTION

In a first aspect, the invention is a blank for a coffin comprising:

a blank body defining a plurality of wall panels each having a pair of opposed sides;

a base supporting member formed integrally with one side of at least certain of the panels; and a flap member formed integrally with the opposite side of at least certain of the panels.

Preferably, each panel has a base supporting member and a flap member associated with it. Each panel and its associated flap member may be demarcated by a first line of weakness. The panel and its associated base supporting member may be demarcated by a second line of weakness. The lines of weakness may be fold lines, grooves, score lines, or any other like means to enable the blank to be manipulated.

The plurality of wall panels may include a first end wall panel, a first side wall panel, a second or subsequent side wall panel(s) and a second end wall panel. Neighbouring panels may be demarcated by a line of weakness.

The first end wall panel may be foldable, substantially at right angles to the first side wall panel, to form at least a portion of a first end wall. The second end wall panel may be foldable, substantially at right angles to the second side wall panel, to form at least a portion of a second end wall opposite the first end wall.

Preferably when forming the coffin, the plurality of wall panels form the external wall and the flap members form the internal wall.

The base supporting member may be foldable, substantially at right angles to its panel, to form a ledge on which a base may be received.

The edges of the base supporting member may be bevelled to facilitate abutment when the blank is erected.

Optionally, or in addition, each flap member may be shorter than its associated panel (as measured parallel to the line of weakness demarcating the flap member from its associated panel) to facilitate folding of the flap member about the line of weakness and bending of the panels about the lines of weakness demarcating adjacent panels.

In use, a pair of blanks may be manipulated to form side and end walls of a coffin. The base supporting members may be bent at right angles to their associated panels to form a ledge on which a base is received.

The blank may also be suitable for forming a casket or coffin of other shape. In an example where the blank is used to form a casket, the blank body comprises a single side wall panel, a first end wall panel and a second end wall panel whilst the base supporting member comprises a single side supporting member with a first end supporting member and a second end supporting member.

The material from which the blank body is formed may be biodegradable. Optionally, or in addition, the material from which the blank body is formed may be flexible. The base may be formed from the same material as the blank body. Optionally, or in addition, the material from which the blank body is formed may be a cellulosic material. Optionally, or in addition, the material may be reinforced by fluting. For instance the material may comprise three layers of fluting sandwiched between four liners. In the case where the material is a fluted material, the blank may be formed such that the direction of the fluting runs across the width of the blank. This may enhance strength to individual areas of the coffin when formed and may additionally prevent warping of panel sections. Optionally, or in addition, the blank may be chosen from a material which meets environmental protection standards.

In a second aspect, the invention is a side wall assembly for a coffin comprising:

a blank as described above; and an insert to be held captive between at least certain of the wall panels of the blank body and their associated flap portions folded onto the wall panels to impart rigidity to a side wall of a coffin formed from the blank.

The insert may be formed from the same material as the blank body.

Preferably the insert includes one or more load bearing support members. The support member(s) may be formed from wood or other rigid material suitable for use in the funeral industry.

A portion may be cut out from the insert and the support member may be inserted into the cut out portion.

The insert may further comprise a plurality of rigid members. The rigid members may be positioned along an edge of the insert. The rigid members may be formed from the same material as the support members.

The insert may adhere against at least a portion of the first side wall panel and at least a portion of the second or subsequent side wall panel.

A pair of end panel inserts may be provided for strengthening ends of the coffin. A first end panel insert may be positioned to overlie the first end wall panel and a portion of the first side wall panel of each of a pair of blanks. A second end panel insert may be positioned to overlie the second end wall panel and a portion of the second side wall panel, of each of the pair of blanks.

The end panel inserts may be formed from the same material as the blank body.

The side wall assembly may further include a base. In an example where the side wall assembly includes a base, the insert may be wholly, or partially, contiguous(integral) with the base. The insert and the base may be demarcated by a line of weakness. The line of weakness may be one of fold lines, grooves, score lines, and any other like means to enable the side wall assembly to be manipulated. The insert may comprise a first panel and a second panel. At least one of the panels may include a wing panel which extends beyond a shoulder joint of the base. The at least one of the panels and the wing panel may be demarcated by a line of weakness as described above.

In the above example a pair of end panel inserts may be provided. A first end panel may be wholly, or partially, contiguous with a head of the base and a second end panel may be wholly, or partially, contiguous with a foot of the base. The first end panel and the head of the base may be demarcated by a line of weakness and the second end panel and the foot of the base may be demarcated by a line of weakness. Optionally, a plurality of end panel inserts may be provided such that each is contiguous with an end of a side panel insert and demarcated by a line of weakness.

In any example, carrying handles may be attached to an exterior surface of the wall panel. Each carrying handle may include a retaining member. The retaining member may penetrate through the wall panel and be secured into the support member to restrain movement of the carrying handle.

In a third aspect, the invention is a lid assembly for a coffin comprising:

a blank body defining a central panel and having a plurality of flap members formed integrally with the central panel; and a lid insert to be held captive between the central panel of the blank body and its associated flap members folded onto the lid insert to impart rigidity to the lid of a coffin formed from the blank.

The central panel may be demarcated from each flap member by a line of weakness. The lines of weakness may be fold lines, grooves, score lines, or any other like means to enable the lid assembly to be manipulated.

The lid insert may comprise a plurality of recesses for the positioning of rigid members. The positioning of the recesses may be such that rigid members, when adhered in the recesses of the lid insert, align with the rigid members of the insert of the side wall assembly, when the lid is secured to a coffin made in accordance with the second aspect of the invention as described above.

In use, retaining members may penetrate through adjacent pairs of strengthening members to secure the lid to the rest of the coffin.

The blank body and the lid insert of the lid assembly may be formed from the same material as the blank body of the first aspect or any of its examples.

An outer decorative coating may be applied to at least a portion of an outer surface of the blank of the first or second aspects, or any of their respective example, and the blank body of the third aspects, or any of its respective examples. The outer surface of the blank and blank body may be decorated by direct printing, laminating or hand crafting. The outer coating may have a personalized design printed thereon. The outer coating may be a lamina, skin, or other like coating such as a polyester film. Optionally, the outer coating may be a paper based product. The outer coating may be suitably chosen such that it meets environmental protection standards.

The printed outer coating may be applied before the coffin or casket is erected or after the coffin or casket has been erected.

Applying the printed outer coating to the blank of the first or second aspects and the blank body of the third aspects may be by way of a mechanical process. For instance the mechanical application may use roll-on techniques as used in the print industry. Optionally, the step of applying the printed outer coating may be by way of a manual process.

The blank in accordance with the first aspect and the side wall assembly may also be suitable for forming a general purpose box.

Advantageously, the blank, the side wall assembly and the lid assembly can be efficiently stored and assembled when required.

An advantage of at least one example of the invention is in the provision of a coffin or casket which offers a high degree of personalization.

A further advantage of at least one example of the invention is in the provision of a relatively inexpensive and aesthetically pleasing coffin.

BRIEF DESCRIPTION OF DRAWINGS

Embodiments of the invention are now described by way of example with reference to the accompanying drawings in which.

BEST MODE FOR CARRYING OUT THE INVENTION

Figure 1:
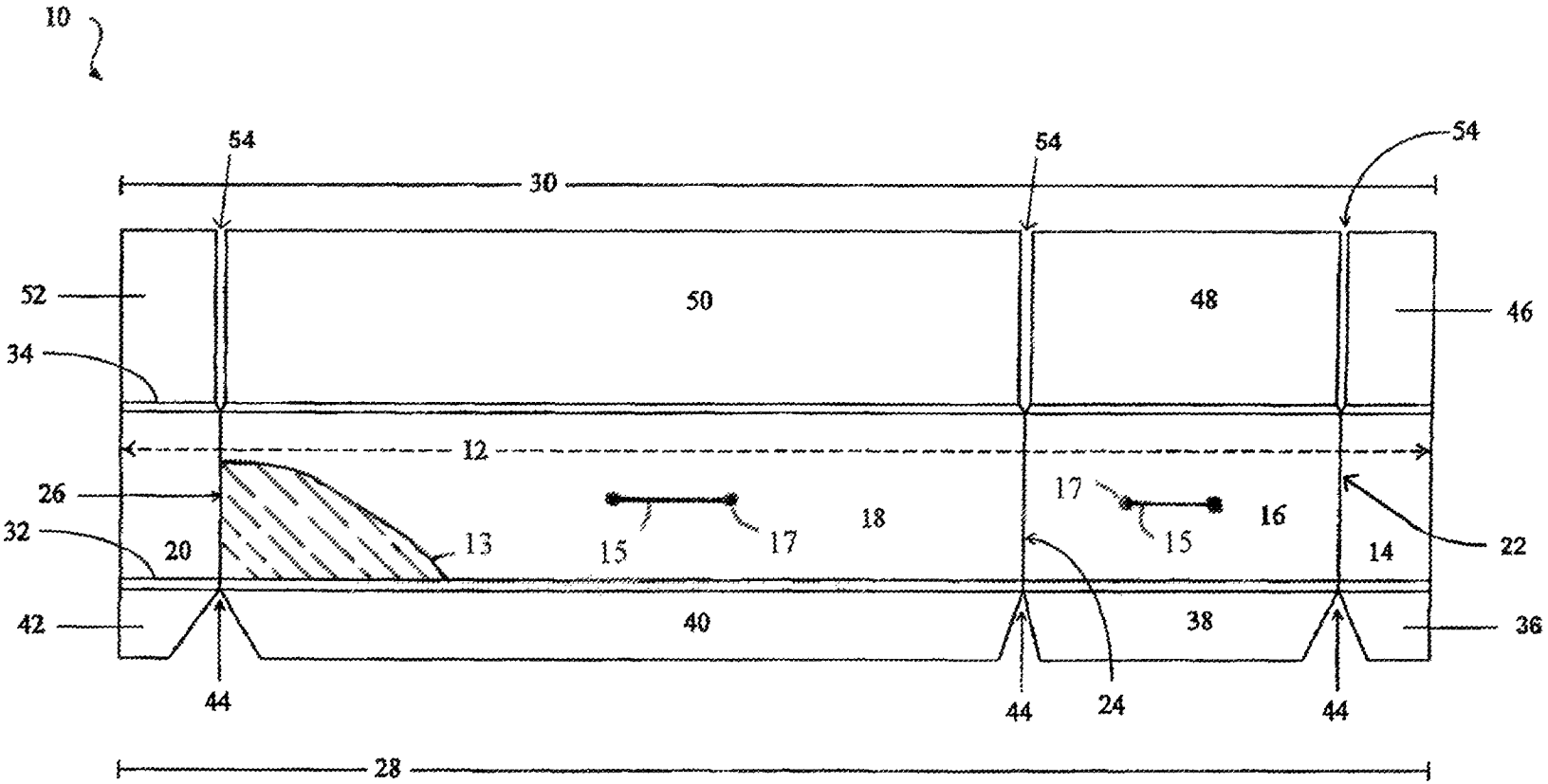
FIG. 1 shows a plan view of a blank for a coffin.

FIG. 1 illustrates a blank for 10 a coffin. The blank 10 is formed from a corrugated board material having one to two layers of fluting sandwiched between two to three liners. The blank 10 includes a blank body 12 which defines a plurality of wall panels; a first end wall panel 14 a first side wall panel 16. a second side wall panel 18 and a second end wall panel 20. The first end wall panel 14 and first side wall panel 16 are demarcated by a line of weakness 22, the first side wall panel 16 and second side wall panel 18 are demarcated by a line of weakness 24 and second side wall panel 18 and second end wall panel 20 are demarcated by a line of weakness 26.

The blank 10 further includes a base supporting member 28 and a flap member 30. The base supporting member 28 is formed integrally with one side of each of the panels 14, 16, 18 and 20 whilst the flap member 30 is formed integrally with the opposite side of each of the panels 14, 16, 18 and 20.

The blank body 12 and the base supporting member 28 are demarcated by a line of weakness 32. The blank body 12 and the flap member 30 are demarcated by a further line of weakness 34. The lines of weakness 22, 24, 26, 32, 34 are fold lines to enable the blank 10 to be manipulated.

The base supporting member 28 defines a first end supporting member 36, a first side supporting member 38, a second side supporting member 40 and a second end supporting member 42. Neighbouring members are separated by notches 44.

The flap member 30 defines a first end flap panel 46, a first side wall flap panel 48, a second side wall flap panel 50 and a second end flap panel 52. A cut out portion 54 separates the first end flap panel 46 from the first side wall flap panel 48 to enable the first end flap panel 46 and first side wall flap panel 48 to be independently and re-entrantly folded about a relevant portion of the fold line 34. Similarly a cut out portion 54 separates the first side wall panel 48 from the second side wall panel 50 and the second side wall panel 50 from the second end wall panel 52.

Figure 2:
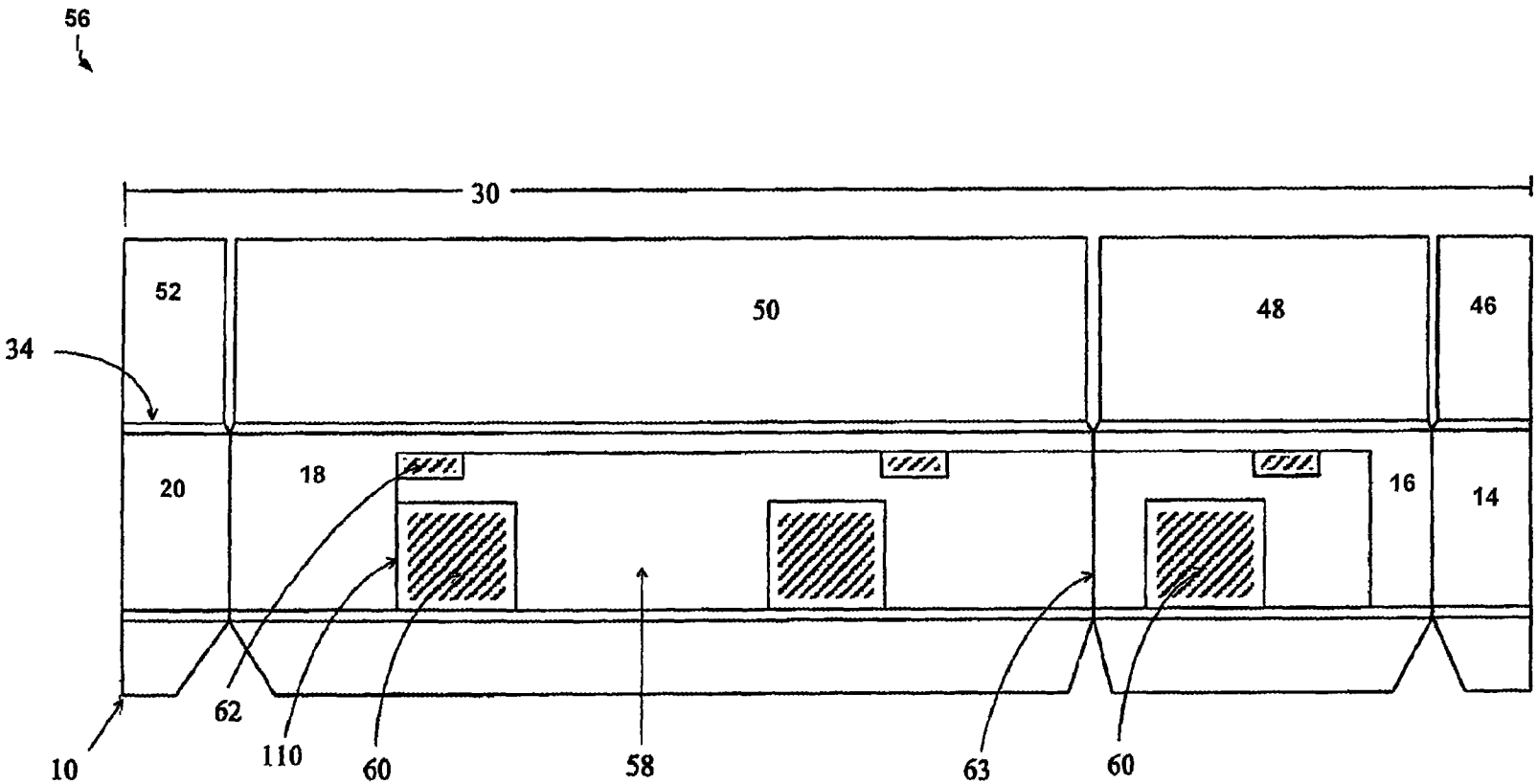
FIG. 2 shows a plan view of a first embodiment of a side wall assembly for a coffin.

FIG. 2 shows a side wall assembly 56 for a coffin. With reference to FIG. 1 of the drawings, like reference numerals refer to like parts unless otherwise specified. The side wall assembly 56 includes a blank 10 and an insert 58. The insert 58 is formed from a thicker material. The insert 58 includes a fold line 63. Support members in the form of rigid tiles 60 are inserted into cut out portions of the insert 58. Strengthening members in the form of rigid blocks 62 are inserted into portions cut out from an upper portion of the insert 58. The length of the rigid members is proportional to the tear strength of the wall panel. To form a side wall, the flap member 30 is re-entrantly folded about the fold line 34 to sandwich the insert 58.

Figure 3:
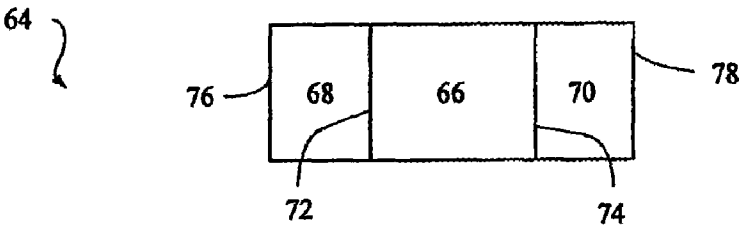
FIG. 3 shows a plan view of a first embodiment of an end panel insert for the coffin illustrated in FIG. 2.

FIG. 3 shows an end wall insert 64. The insert 64 is comprised of a central section 66 with opposing wing sections 68 and 70. Wing section 68 and the central section 66 are demarcated by a line of weakness in the form of a fold line 72 and the central section 66 and wing section 70 are demarcated by a line of weakness in the form of a fold line 74.

Figure 4:
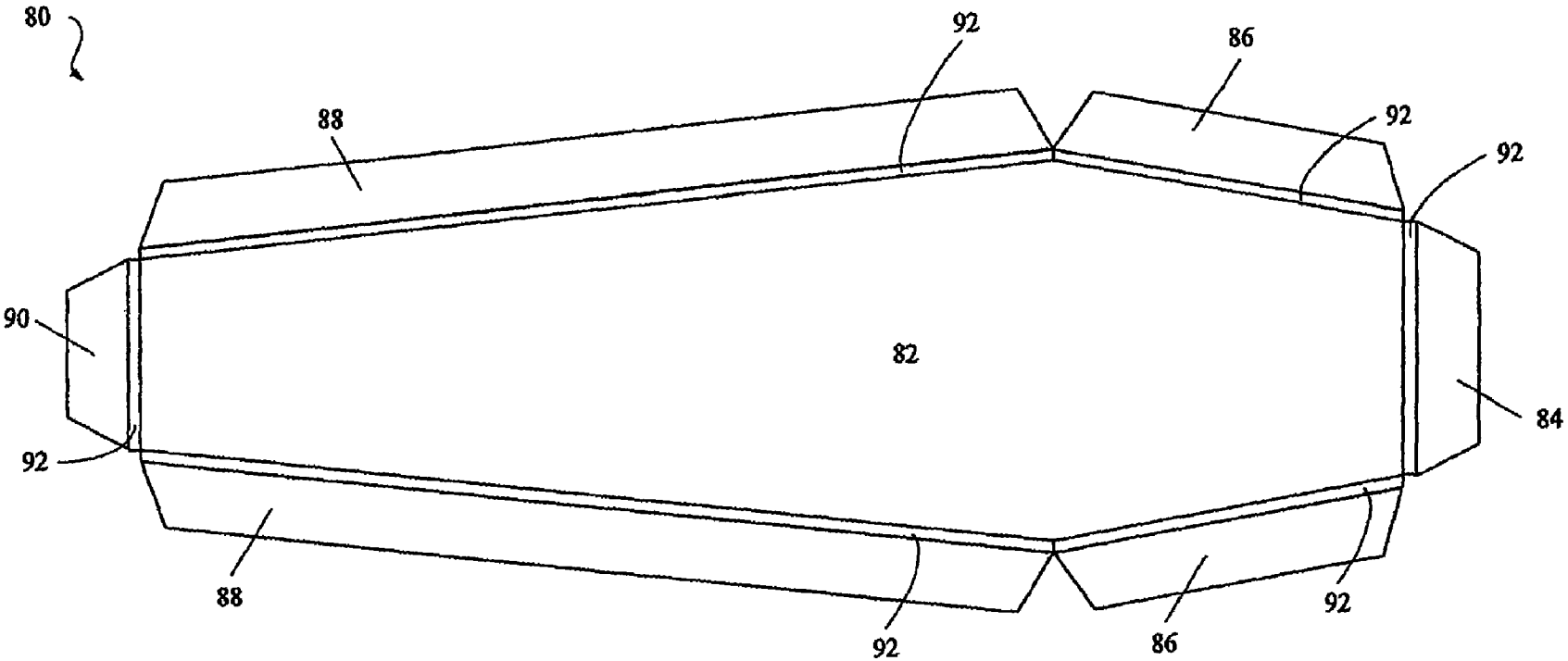
FIG. 4 shows a plan view of a lid for a coffin.

FIG. 4 shows a plan view of a blank body 80 for a lid of a coffin. The blank body 80 has a central panel 82, a first end flap member 84, a pair of first side flap members 86, a pair of second side flap members 88 and a second end flap member 90. The central portion 82 and each respective flap member 84, 86, 88, 90 are demarcated by a line of weakness in the form of a fold line 92.

Figure 5:
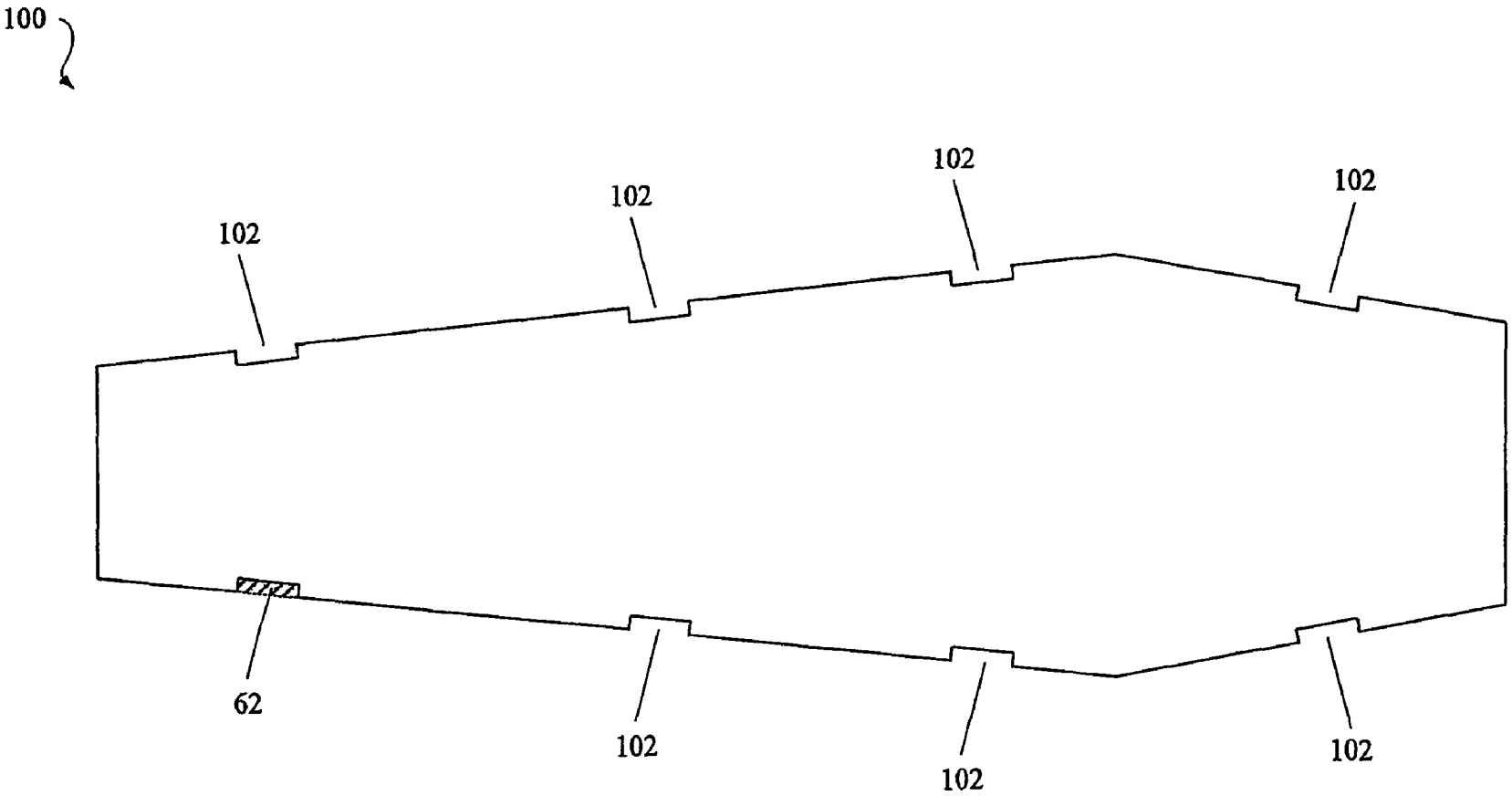
FIG. 5 shows a plan view of a lid/base insert.

FIG. 5 shows a lid and base insert 100. A plurality of recesses 102 are cut out from side edges of the lid/base insert 100 into which strengthening members in the form of rigid blocks 65 are glued (of which only one is shown).

Formation of a coffin first involves pre-assembly of a pair of inserts 58 for a pair of side wall assemblies 56 and pre-assembly of a lid insert 100. Rigid tiles 60 and rigid blocks 62 are glued into the relevant cut out portions of each insert 58 and rigid blocks 65 are glued into recesses 102 cut out from the lid panel insert 100. The positioning of the recesses 102 in the lid panel insert 100 is arranged such that the rigid blocks 65 glued within the recesses 102 will be in register with the rigid blocks 62 positioned in the cut out portions of the insert 58, when the lid insert 100 is attached to the lid 80 and the lid 80 is secured to the coffin.

As illustrated in FIG. 1, an outer decorative coating 13 of personalized design, having been pre-printed onto a thin film or directly printed onto the external surfaces, is then applied to the entirety of the outer surface of each of the blanks 10 by way of mechanical or manual process. Similarly, the outer decorative coating 13 may also be applied to the entirety of the outer surface of the blank body 80 of the lid by way of the mechanical or manual process.

Next, flaps 84, 86, 88 and 90 of the blank body 80 of a lid, are all pre-folded about the respective fold lines 92. Similarly, flap member 30 and base supporting member 28 of each blank 10 are pre-folded about the respective fold lines 34 and 32, and first end wall panel 14, first side wall panel 16 and second end wall panel 20 are pre-folded about fold lines 22, 24 and 26. A first end wall insert 64 and a second end wall insert 64 are selected and wing sections 68 and 70 pre-folded about respective fold lines 72 and 74.

Lid insert 100 is then adhered to the blank body 80 by gluing the lid insert 100 to an inner surface of the central panel 82 of the blank body 80. The flaps 84, 86, 88 and 90 are then re-entrantly folded and glued to the lid insert 100.

One of the end walls of the coffin is then formed. The pair of blanks 10 are laid flat with outer edges of respective second end flap panels 52, second end wall panels 20 and second end base supporting members 42 abutting one another to form an end wall abutment line. The second end wall insert 64 is centred about the end wall abutment line such the fold lines 72 and 74 overlap the respective fold lines 26. The central section 66 of the second end wall insert 64 is then glued to both second end wall panels 20. Wing sections 68 and 70 of second end wall insert 64 are glued to the second side wall panels 18 of the respective blanks 10. Second end flap panels 52 of each blank 10 are then folded over and glued to the central section 66 of the second end wall insert 64.

Each of the pre-assembled inserts 58 is then adhered to one of the blanks 10. Each insert 58 is positioned against its blank 10 so that an edge 110 of one of the inserts 58 abuts an edge 76 of the second end wall insert 64 and an edge 110 of the other insert 58 abuts an edge 78 of the second end wall insert 64. The inserts 58 are glued to the first side wall panels 16 and second side wall panels 18 of each of the blanks 10.

An outer edge of the respective first end flap panels 46, first end wall panels 14 and first end tabs 36 are abutted to form a first end wall abutment line. The first end wall insert 64 is centred about the abutment line and glued to the first end wall panels 14 of the blanks 10. Wing sections 68 and 70 of the first end wall insert 64 are glued to the first side wall panel 16 of the respective blanks 10. The first end flap panels 46 of each blank 10 are then folded over and glued to the central section 66 of the first end wall insert 64.

A base insert 100, having the same dimensions as the central panel 82 of the blank body 80 of the lid and formed from the same material, is positioned and each flap member of the base supporting member 28 folded, substantially at right angles to the wall panel 12, to form a ledge on which the base 100 sits. The base insert 100 is glued to flap members 36, 38, 40 and 42 of the base supporting members 28.

Alternatively the personalized thin film could be applied to the coffin at this stage.

Handles 15 are then positioned and a pair of retaining members 17 associated with each handle are screwed through the pre-formed positions to secure the handles to the coffin.

A waterproof liner (not shown) is attached to the inside of the coffin and overlaid with a cosmetic liner. The lid is able to be fastened by screwing through each rigid block 65 and into the adjacent rigid block 62 in the insert 58. The use of the rigid blocks 62, 65 is advantageous as coffins manufactured from cardboard or other like material are prone to being torn.

Figure 6:
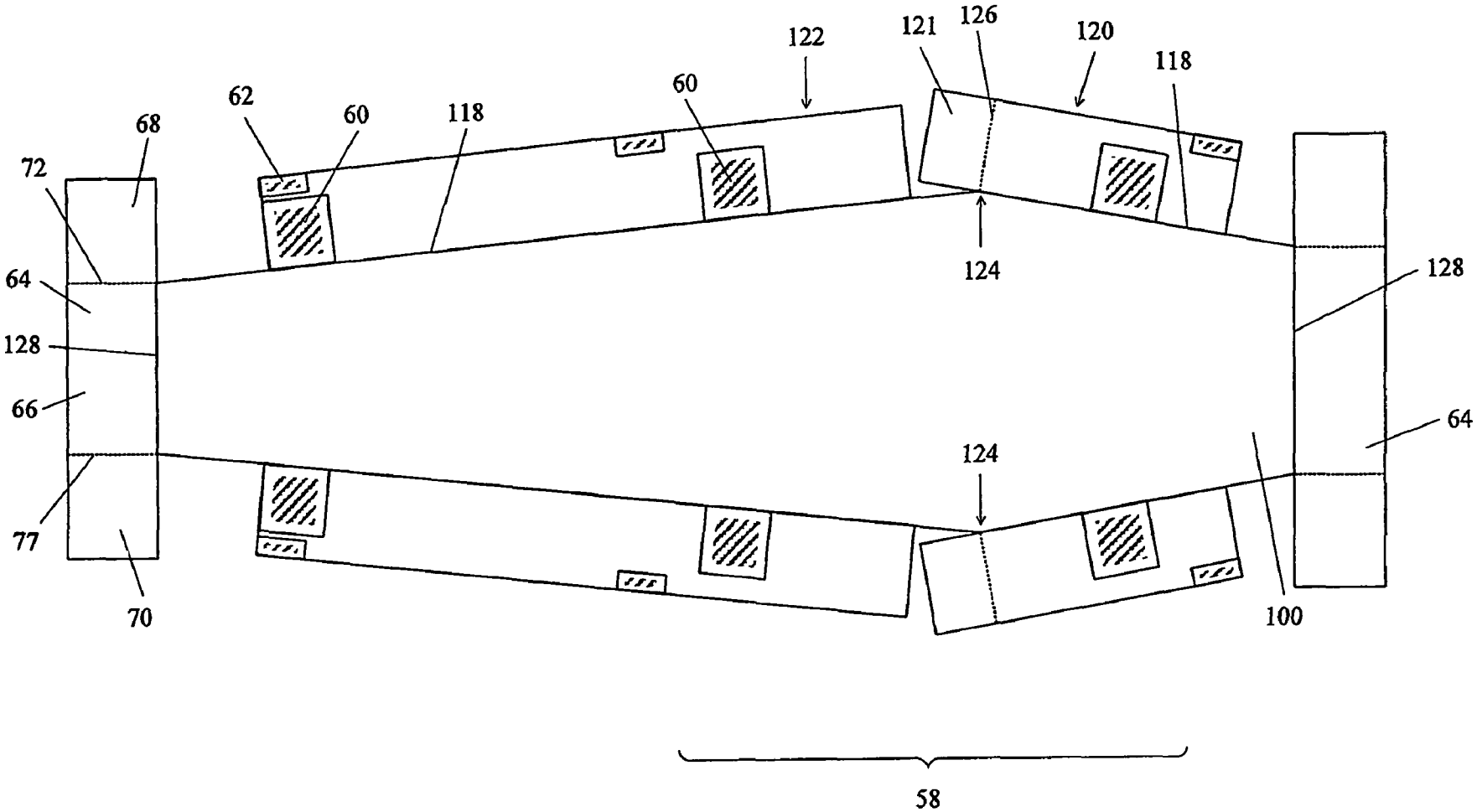
FIG. 6 shows a plan view of a second embodiment of a side wall assembly for a coffin.
Figure 7:
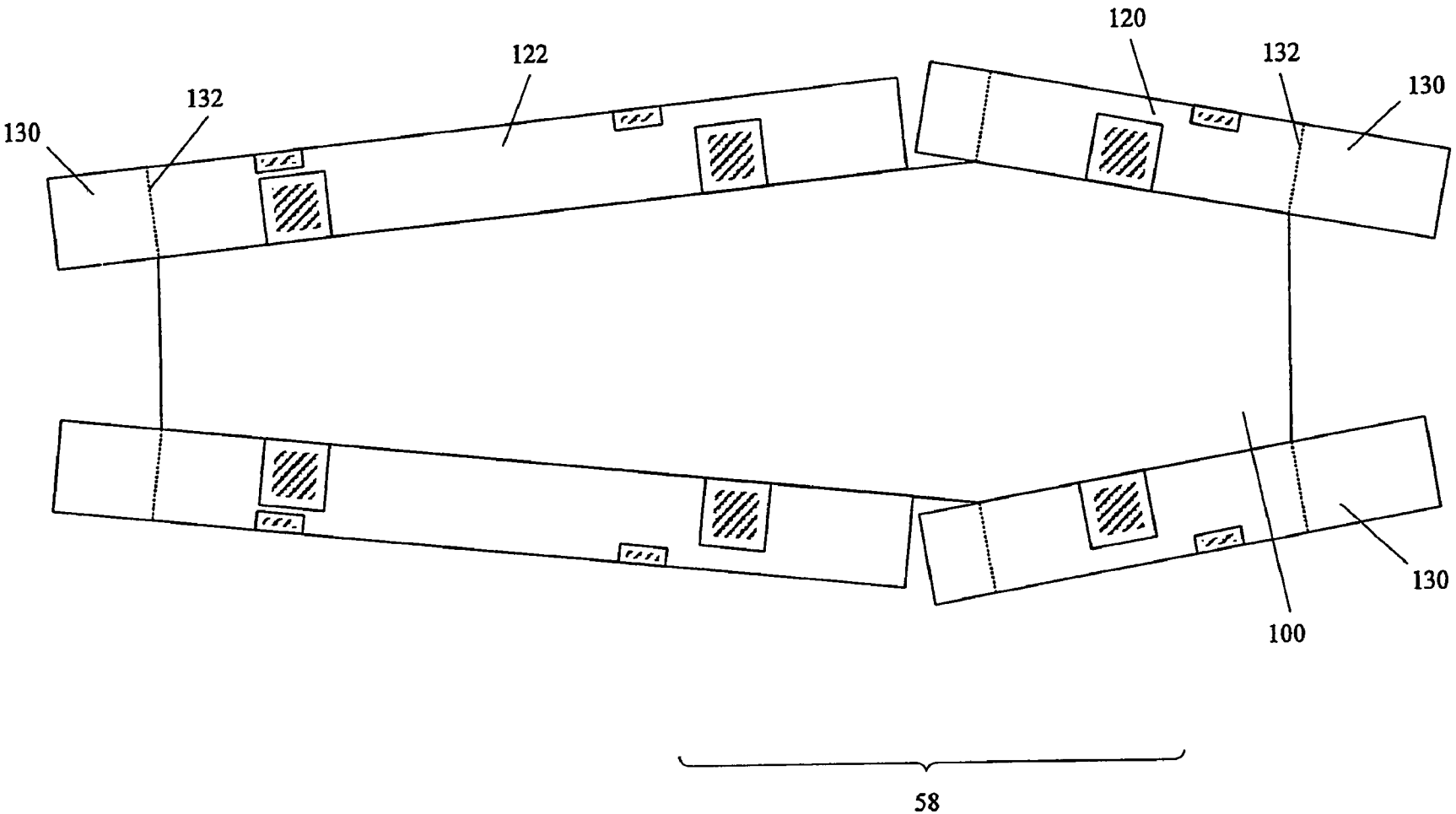
FIG. 7 shows a plan view of a third embodiment of a side wall assembly for a coffin.

FIGS. 6 to 8 illustrate optional embodiments of the invention. FIG. 6 illustrates an example where a pair of inserts 58 are partially contiguous with the base insert 100. The base insert 100 and the pair of inserts 58 are demarcated by a line of weakness 118 in the form of a fold line. Each insert 58 includes a first panel 120 and a second panel 122. The first panel 120 includes a wing panel 121 which extends beyond a shoulder joint 124, and further includes a fold line 126 located adjacent the shoulder joint 124. As in the former figures, support members in the form of rigid tiles 60 are inserted into cut out portions of the first and second panels 120, 122, and strengthening members in the form of rigid blocks 62 are inserted into portions cut out from an upper portion of the first and second panels 120, 122.

In this example a pair of end wall inserts 64 are partially contiguous with the base insert 100. The base insert 100 and the pair of end wall inserts 64 are demarcated by a line of weakness 128 in the form of a fold line. As in FIG. 3, each insert 64 is comprised of a central section 66 with opposing wing sections 68 and 70. Wing section 68 and the central section 66 are demarcated by a line of weakness in the form of a fold line 72 and the central section 66 and wing section 70 are demarcated by a line of weakness in the form of a fold line 74.

The base insert 100, pair of inserts 58 and end wall inserts 64 illustrated in FIG. 7 are substantially the same as those illustrated in FIG. 6, however in this example it is the second panel 122 which includes a wing panel 121 which extends beyond the shoulder joint 124.

In the example illustrated in FIG. 8, the base insert 100, and pair of inserts 58 are the same as those illustrated in FIG. 6. What differentiates this example from the example shown in FIG. 6 is that the end wall inserts 130 are extensions of the respective first panels 120 of the pair of inserts 58 and respective second panels 122 of the pair of inserts 58. Each end wall insert 130 and the associated first panel 120 or second panel 122 are demarcated by a line of weakness 132 in the form of a fold line.

In all of the examples illustrated, the configuration of the inserts 58 is such that strength is imparted across the shoulder joint.

It will be appreciated that the plurality of wall panels may include any number of side wall panels.

It will be appreciated that for a casket, the blank body would comprise a single side wall panel and first and second end wall panels whilst the base supporting member would comprise a single side supporting member with first and second end supporting members.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A coffin blank, comprising:

a blank body defining a plurality of wall panels, each wall panel having a dedicated pair of opposed sides, the plurality of wall panels including a first end wall panel, at least a first side wall panel and a second side wall panel, and a second end wall panel, wherein said plurality of wall panels cooperate to form a body portion of a coffin; and for each panel, a base supporting member formed integrally with one side of the panel, and a flap member formed integrally with the opposite side of the panel, wherein each base supporting member is foldable, substantially at right angles to its panel, to form a ledge on which a base is receivable.

2. The coffin blank according to claim 1, wherein each panel and its associated flap member are demarcated by a first line of weakness and each panel and its associated base supporting member are demarcated by a second line of weakness.

3. The coffin blank according to claim 2, wherein the lines of weakness enable the blank to be manipulated and comprise one of fold lines, grooves, and score lines.

4. The coffin blank according to claim 1, wherein the first end wall panel and the first side wall panel, the second side wall panel and the second end wall panel, and the first side wall and the second side wall panel, are each demarcated by a line of weakness.

5. The coffin blank according to claim 1, wherein an edge of the base supporting member is bevelled to facilitate abutment when the blank is erected.

6. The coffin blank according to claim 1, wherein the blank body is formed from a biodegradable material.

7. The coffin blank according to claim 6, wherein the material is a fluted material.

8. The coffin blank according to claim 7, wherein the material comprises one or more layers of material sandwiched between two or more layers of a liner.

9. The coffin blank according to claim 1, further comprising an outer decorative coating applied to at least a portion of an outer surface of the blank body.

10. The coffin blank according to claim 9, wherein the outer coating has a personalised design printed thereon.

11. A coffin side wall assembly, comprising:

at least one blank comprising:

a blank body defining a plurality of wall panels cooperating to form a body portion of a coffin, each wall panel having a dedicated pair of opposed sides;

for each wall panel, a base supporting member formed integrally with one side of the wall panel; and a flap member formed integrally with the opposite side of the wall panel; and at least one insert, each insert held captive between one of the wall panels and the one of the wall panel's associated flap member, the associated flap member folded onto the one of the wall panels to impart rigidity to the coffin side wall assembly, wherein the insert receives a load bearing support member, and wherein each wall panel and its associated flap member is demarcated by a first line of weakness.

12. The coffin side wall assembly according to claim 11, wherein a portion is cut out from the insert, and the support member is insertable into the cut out portion.

13. The coffin side wall assembly according to claim 12, wherein the insert further comprises a plurality of rigid members positioned along an edge of the insert.

14. The coffin side wall assembly according to claim 11, wherein each wall panel and its associated base supporting member are demarcated by a second line of weakness.

15. The coffin side wall assembly according to claim 14, wherein the lines of weakness enable the blank to be manipulated and comprise one of fold lines, grooves, and score lines.

16. The coffin side wall assembly according to claim 15, wherein the plurality of wall panels include a first end wall panel, at least a first side wall panel and a second side wall panel, and a second end wall panel.

17. The coffin side wall assembly according to claim 16, wherein the first end wall panel and the first side wall panel, the second side wall panel and the second end wall panel, and the first side wall panel and the second side wall panel, are each demarcated by a line of weakness.

18. The coffin side wall assembly according to claim 17, wherein the first end wall panel is foldable, substantially at right angles to the first side wall panel, to form at least a portion of a first end wall.

19. The coffin side wall assembly according to claim 18, wherein the second end wall panel is foldable, substantially at right angles to the second side wall panel, to form at least a portion of a second end wall opposite the first end wall.

20. The coffin side wall assembly according to claim 16, further comprising first and second panel inserts to be disposed at opposite ends of the coffin to at least partly overlie respective first and second end wall panels for strengthening the ends of the coffin.

21. The coffin side wall assembly according to claim 20, wherein the assembly comprises a pair of blanks and wherein the first end panel insert is positioned to overlie the first end wall panel and a portion of the first side wall panel of each of the pair of blanks and the second end panel insert is positioned to overlie the second end wall panel and a portion of the second side wall panel, of each of the pair of blanks.

22. The coffin side wall assembly according to claim 11, wherein an edge of the base supporting member is bevelled to facilitate abutment when the blank is erected.

23. The coffin side wall assembly according to claim 11, wherein the blank body is formed from a biodegradable material.

24. The coffin side wall assembly according to claim 23, wherein the material comprises three or more layers of fluted material sandwiched between two or more layers of a liner.

25. The coffin side wall assembly according to claim 11, further comprising a base, wherein the insert comprises a first panel insert and a second panel insert, each of the first panel insert and the second panel insert at least partially contiguous with the base.

26. The coffin side wall assembly according to claim 25, wherein contiguous portions of the first panel insert and the second panel insert are each demarcated from the base by a line of weakness.

27. The coffin side wall assembly according to claim 25, further comprising a first end panel at least a portion of which is contiguous with a head of the base and a second end panel at least a portion of which is partially contiguous with a foot of the base.

28. The coffin side wall assembly according to claim 11, further comprising carrying handles, each carrying handle coupled to an exterior surface of one of the wall panels.

29. The coffin side wall assembly according to claim 28, wherein each carrying handle includes a retaining member which penetrates through the wall panel to which the carrying handle is coupled, the support member, and the flap member associated with the wall panel to which the carrying handle is coupled, when the flap member associated with the wall panel is re-entrantly folded to sandwich the support member between the wall panel and the flap member.

30. The coffin side wall assembly for a coffin according to claim 11, further comprising an outer decorative coating applied to at least a portion of an outer surface of the blank body.

31. The coffin side wall assembly for a coffin according to claim 30, wherein the outer coating has a personalised design printed thereon.

32. A coffin lid assembly, comprising:

a blank body forming a lid of a coffin, said blank body defining a central panel and having a plurality of flap members formed integrally with the central panel; and a lid insert to be held captive between the central panel of the blank body and its associated flap members, the flap members folded onto the lid insert to impart rigidity to the coffin lid assembly, wherein the lid insert comprises a plurality of recesses for the positioning of rigid members.

33. The coffin lid assembly according to claim 32, wherein the central panel is demarcated from each flap member by a line of weakness.

34. The coffin lid assembly according to claim 33, further comprising an outer decorative coating applied to at least a portion of an outer surface of the blank body.

35. The coffin lid assembly according to claim 33, wherein the outer coating has a personalised design printed thereon.

* * * * *